United States Patent [19]

Uetani

[11] Patent Number: 4,542,463

[45] Date of Patent: Sep. 17, 1985

[54] GROUP SUPERVISORY CONTROL SYSTEM FOR ELEVATOR

[75] Inventor: Kenichi Uetani, Inazawa, Japan

[73] Assignee: Mitsubishi Denki Kabushiki Kaisha, Tokyo, Japan

[21] Appl. No.: 450,385

[22] Filed: Dec. 16, 1982

[30] Foreign Application Priority Data

Dec. 28, 1981 [JP] Japan ..... 56-211346

[51] Int. Cl.[4] ..... B66B 1/18

[52] U.S. Cl. ..... 364/424; 187/29 R; 364/478; 364/554

[58] Field of Search ..... 364/424, 550, 551, 478, 364/554, 300; 187/29 R, 29 SC

[56] References Cited

U.S. PATENT DOCUMENTS

| | | | |
|---|---|---|---|
| 3,593,825 | 7/1971 | Gieseler | 187/29 R |
| 4,193,478 | 3/1980 | Keller et al. | 187/29 R |
| 4,244,450 | 1/1981 | Umeda et al. | 187/29 |
| 4,411,338 | 10/1983 | Kuzunnuki et al. | 187/29 R |
| 4,448,286 | 5/1984 | Kuzunnuki et al. | 187/29 R |
| 4,473,134 | 9/1984 | Uetani | 187/29 R |

OTHER PUBLICATIONS

Japanese Unexamined Patent Publication No. 115,566/1980, "Group Supervisory Control System for Elevator", Yasuhiro Suzuki.

U. S. Serial No. 355,113 filed on Mar. 5, 1982, by Mitsubishi Denki Kabushiki Kaisha, "Group Supervisory Control System for Elevator".

*Primary Examiner*—Edward J. Wise

*Attorney, Agent, or Firm*—Oblon, Fisher, Spivak, McClelland & Maier

[57] ABSTRACT

A group supervisory control system for an elevator which statistically operates to obtain traffic data on the elevator for time zones divided in the previous operation and controls the driving operation of cars based on thus obtained statistical data and which comprises a traffic data recording circuit for recording the traffic data of the elevator for the previously divided time zones and a time zone setting device for setting time zones when a predetermined condition concerning the data recorded in the traffic data recording circuit is established.

4 Claims, 13 Drawing Figures adder
gate circuit
memory circuit
comparator
counter
comparator
subtracter
divider
gate circuit
gate circuit
gate circuit
gate circuit
delay circuit
OR
OR
No. 2 car stop circuit
No. 3 car stop circuit
shift register
112a
108a
100
112
111
108
104
103
102
101
110
109
107
106
92
99
100
98A
98AA
90bA
90aA
98BA
98B
90bB
90aB
98C
90bC
90aC
84
94
96
89a
91
93
112a
95
97
P0
P1
P2
P3

GROUP SUPERVISORY CONTROL SYSTEM FOR ELEVATOR

BACKGROUND OF THE INVENTION

1. Field of the Invention

The present invention relates to an improved apparatus for group supervisory control system for an elevator.

2. Description of the Prior Art

In the typical group supervisory control system for an elevator system, when a hall call is registered, an elevator car suitable for responding to the hall call is selected dependent on data required for the group supervisory control, whereby the hall call is allocated to use a car.

Proposals have been made in publications such as the Japanese Unexamined Patent Publication No. 115566/1980 in which a day is divided into a plurality of time zones and traffic and service data for an elevator are statistically gathered for each previous time zone in order to perform group supervisory control for elevator cars.

The conventional system is illustrated in FIGS. 1 to 3.

In the figures, the reference numeral (1) designates a car controlling apparatus for controlling cars (only one apparatus is shown in the figure); (1*a*) designates car condition data such as a car call, car load, car direction; (2) designates a group supervisory control system; (2*a*) designates data for statistics such as condition of each car, waiting time of a hall call, an estimated floor for response; (2*b*) designates a group supervisory data such as the floor allocated by the hall call; (2*c*) designates a hall call registration releasing signal; (3) designates a statistical apparatus for statistic operation of traffic and service data for an elevator; (3*a*) designates statistical data such as a hall call probability, a car call probability, the passage entering times at each floor; (4) designates exterior apparatuses such as a hall call detection apparatus, a waiting passenger number detection apparatus; (4*a*) designates a hall signal such as a hall button signal, a signal indicative of the number of waiting passengers; (6) designates an up-call button signal which changes to "H" by operating the up-call button (not shown) at the first floor; (7) designates a counter which counts number of times input I changing to "H" to output signals and is reset to zero when an input R changes to "H"; (8) designates a gate circuit for outputting the input I when an input G changes to "H"; (9) designates an adder for adding inputs A and B; (10) designates a time zone renewal pulse which changes to "H" with a predetermined time interval (for example, for each one hour); (11) designates a delay circuit whose output changes to "H" with a predetermined delay when an input changes to "H"; (12*a*), (12*b*), . . . (12*x*) designate time zone signals shown in FIG. 3 wherein (12*a* ) designates the time zone signal which is in "H" level from the time when the time zone renewal pulse (10) in "H" at 7 a.m. changes to "L" to the time when the pulse in "H" at 8 a.m. changes to "L"; (12*b*) designates the time zone signal, similar to the signal (12*a*), which is in "H" level from 8 a.m. to 9 a.m. and (12*x*) designates the time zone signal, similar to the previous signals, which keeps "H" state from 6 a.m. to 7 a.m.; (13A)–(13X) [(13D)–(13X) are not shown] designate AND gates; (14)–(37) [(17)–(37) are not shown] designate call times memory circuits for each time zone; (14A)–(37A) [(17A)–(37A) are not shown] designate gate circuits similar to the gate circuit (8); (14B)–(37B) [(17B)–(37B) are not shown] designate memory circuits which memorize data of the input I to output signals and are reset to zero when the input R changes to "H"; (14C)–(37C) [(17C)–(37C) are not shown] designate gate circuits similar to the gate circuit (8); (38) designates a counter similar to the counter (7); (39) designates a reset signal which changes to "H" at 0:00 a.m. on Sunday; (40) designates a divider for outputting a value by dividing the input A by the input B; (41) designates a memory circuit similar to the memory circuits (14B)–(37B) [(17B)–(37B) are not shown]; and (41*a*) designates the output of the memory circuit (41) as a first floor up-call probability signal included in the statistical data (3*a*) of the FIG. 1. The same circuit is provided at each floor other than the first floor and also in the down-call system.

When the up-call button at the first floor is operated, the up-call bottom signal (6) changes to "H" whereby the counter (7) counts the number, that is, the number of operations of the up-call button. When the time zone renewal pulse (10) changes to "H" at 7 a.m. the gate circuit (8) is opened and the times of call occurring in one hour from 6 a.m. to 7 a.m. which is counted by the counter (7) are input to the adder (9). The output of the delay circuit (11) changes to "H" with a predetermined time delay after the time zone renewal pulse (10) changes to "H" whereby the counter (7) is reset to start recounting. When the time zone signal (12*a*) changes to "H", the gate circuit (14*c*) is opened to output the total value accumulated in the memory circuit (14B) from the previous day, that is, the total counts of the call times accumulated during one hour from 7 a.m. to 8 a.m. from the previous day. On the other hand, the counter (38) counts the number of times zones (12*a*), i.e., the number of the days and accordingly, the mean value per day of the call times occurring in one hour from 7 a.m. to 8 a.m. is calculated by the divider (40). The value is memorized in the memory circuit (41) and is output as a call times probability signal (41*a*). On the other hand, the output of the gate circuit (14*c*) is input to the adder (9) to be added with the call times during previous one hour. When the time zone renewal pulse (10) changes to "H" at 8 a.m., the output of the AND gate (13A) changes to "H" to open the gate circuit (14A) whereby the data of the adder (9) is memorized in the memory circuit (14B). When the time zone signal (12*a*) changes to "L", the gate circuits (14A), (14C) are closed and simultaneously, the time zone signal (12*b*) changes to "H" to open the gate circuit (15*c*) whereby the total value of the call times occurring in one hour from 8 a.m. to 9 a.m. which has been accumulated from the previous day is output and the mean value per day is output from the divider (40). When it is 0:00 a.m. on Sunday, the reset signal (39) changes to "H" to reset all the call times on each time zone. As a result, the output of the divider (40) is given as the mean value for a week for each time zone. The same description can be applied to the floors other than the first floor and also to the down-call.

Thus, the call time probability signal (41*a*) indicative of the means value of the call times is fed to the group supervisory control apparatus (2) as the statistical data to perform a group supervisory control.

The traffic condition of an elevator greatly varies dependent on time zones as shown in FIG. 4. In the conventional system, the time zones having the same time width are applied as shown in the time axis TA, to the time from 8 p.m. to 5 a.m. which indicates a small change in traffic condition at night and to the times of 7 a.m.–9 a.m., 11 a.m.–1 p.m. and 4 p.m.–6 p.m. which indicate large changes in traffic condition in day. The statistical data for time zones in which the change of traffic condition is large become coarse thereby resulting in inferior elevator services. In order to increase the number of time zones to improve the disadvantage, the number of the call times memory circuits (14)–(37) must be increased thereby increasing cost. It can be considered that long time zones are provided at night time as a fixed time zone. However, it may vary dependent on buildings and the seasons.

SUMMARY OF THE INVENTION

It is an object of the present invention to overcome the disadvantage of the conventional system and to provide a group supervisory control system for an elevator which provides a correct statistical data without increasing memory capacitor and improved services by determining time zones when a predetermined condition concerning traffic and service data is established.

The foregoing and the other object of the present invention have been attained by providing a group supervisory control system for an elevator which satistically operates to obtain traffic data on the elevator for time zones divided in the previous operation and controls the driving operation of cars based on thus obtained statistical data, which comprises a traffic data recording circuit for recording the traffic data of the elevator for the previously divided time zones and a time zone setting device for setting time zones when a predetermined condition concerning the data recorded in the traffic data recording circuit is established.

DETAILED DESCRIPTION OF THE PREFERRED EMBODIMENTS

Figure 5:
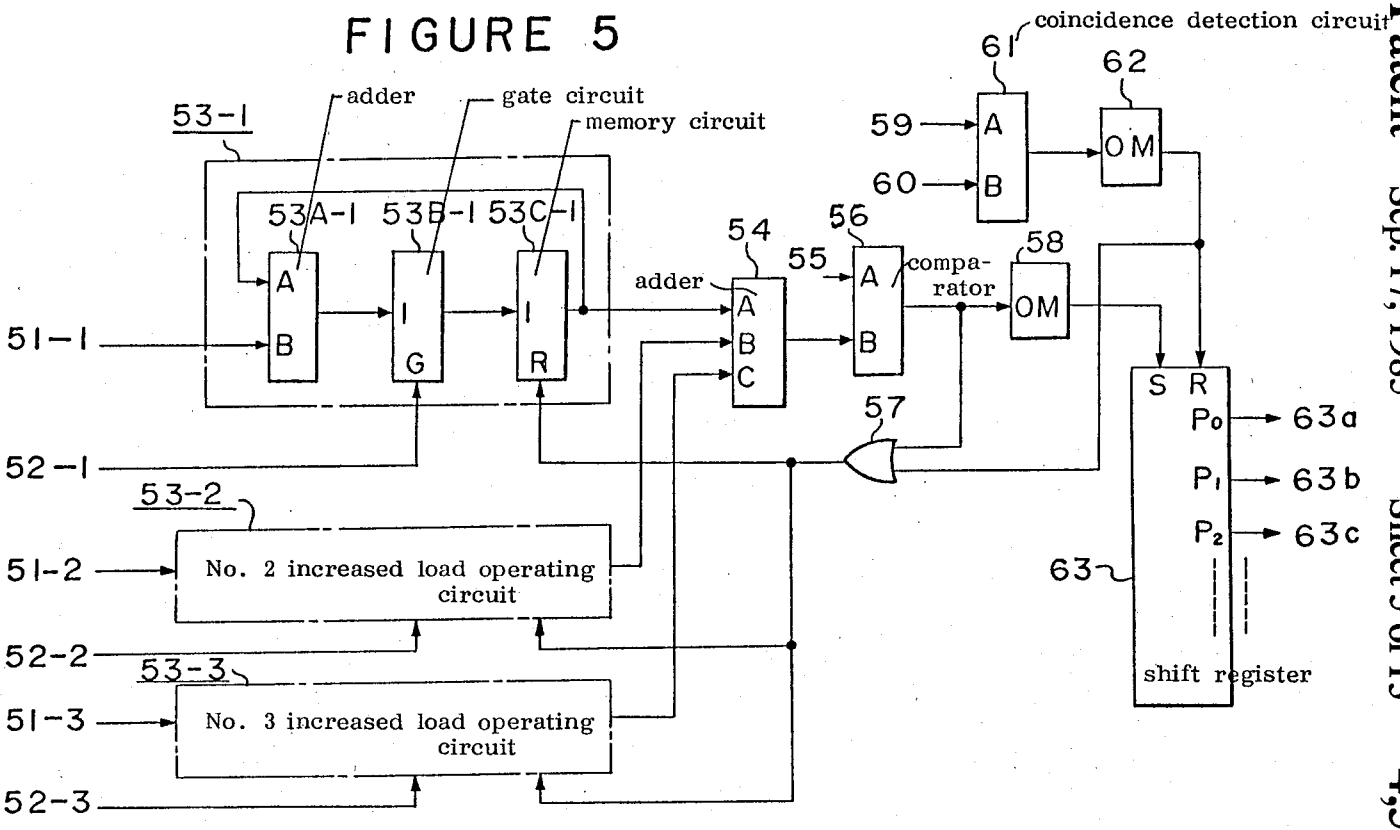
FIGS. 5 and 6 are block diagrams of an embodiment of the group supervisory control system of the present invention.
Figure 6:
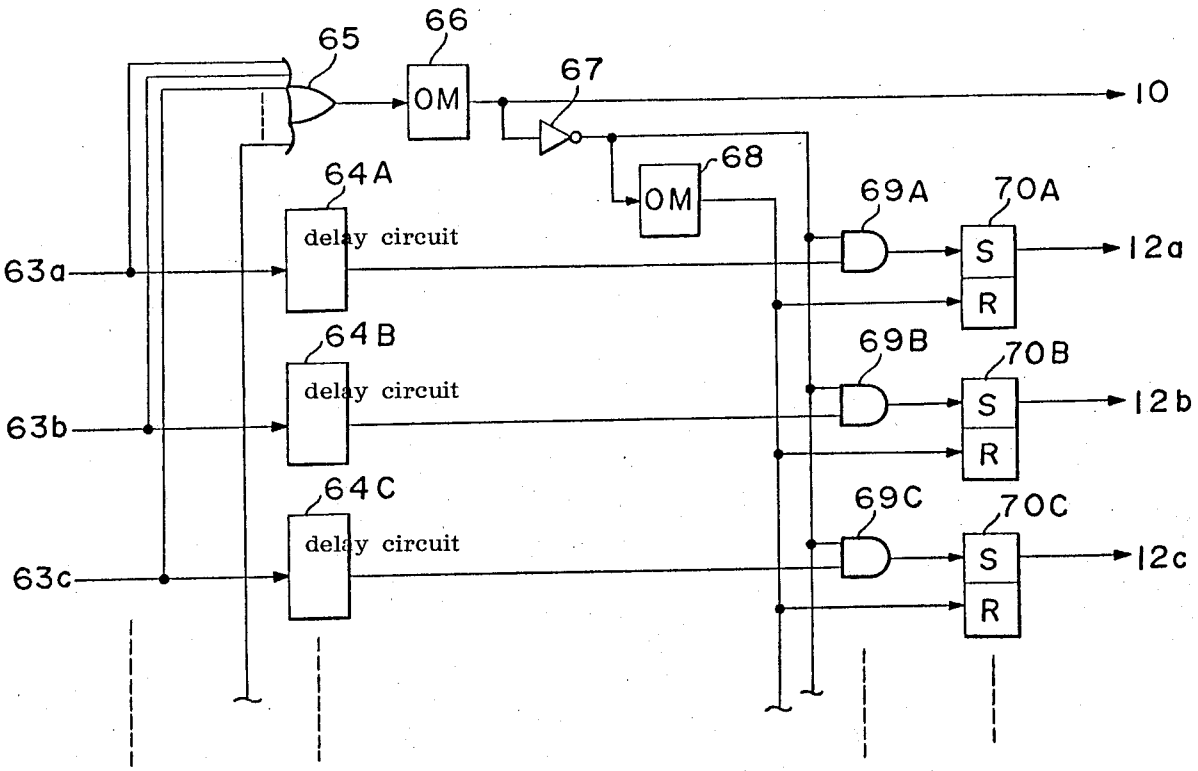
Figure 7:
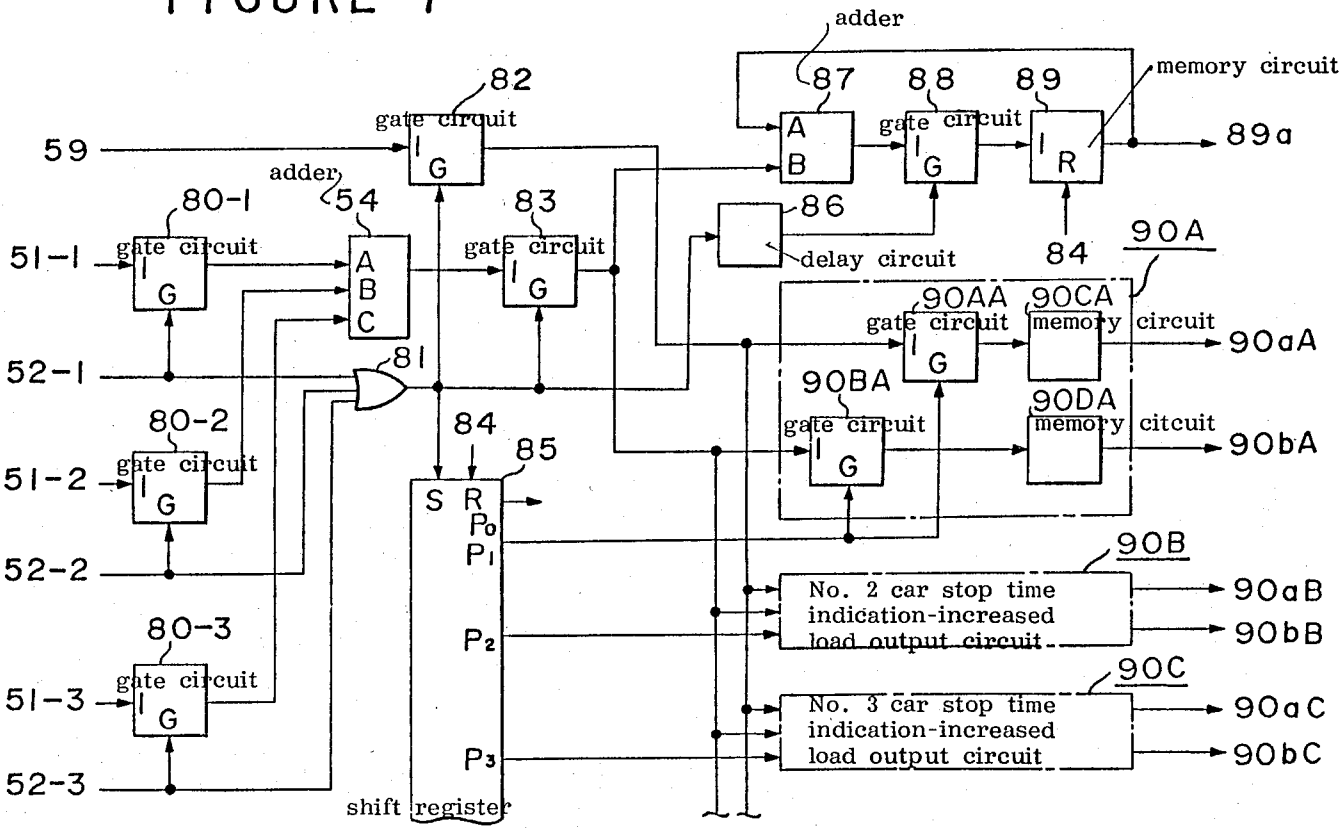
FIGS. 7 to 10 are block diagrams of another embodiment of the present invention.
Figure 8:
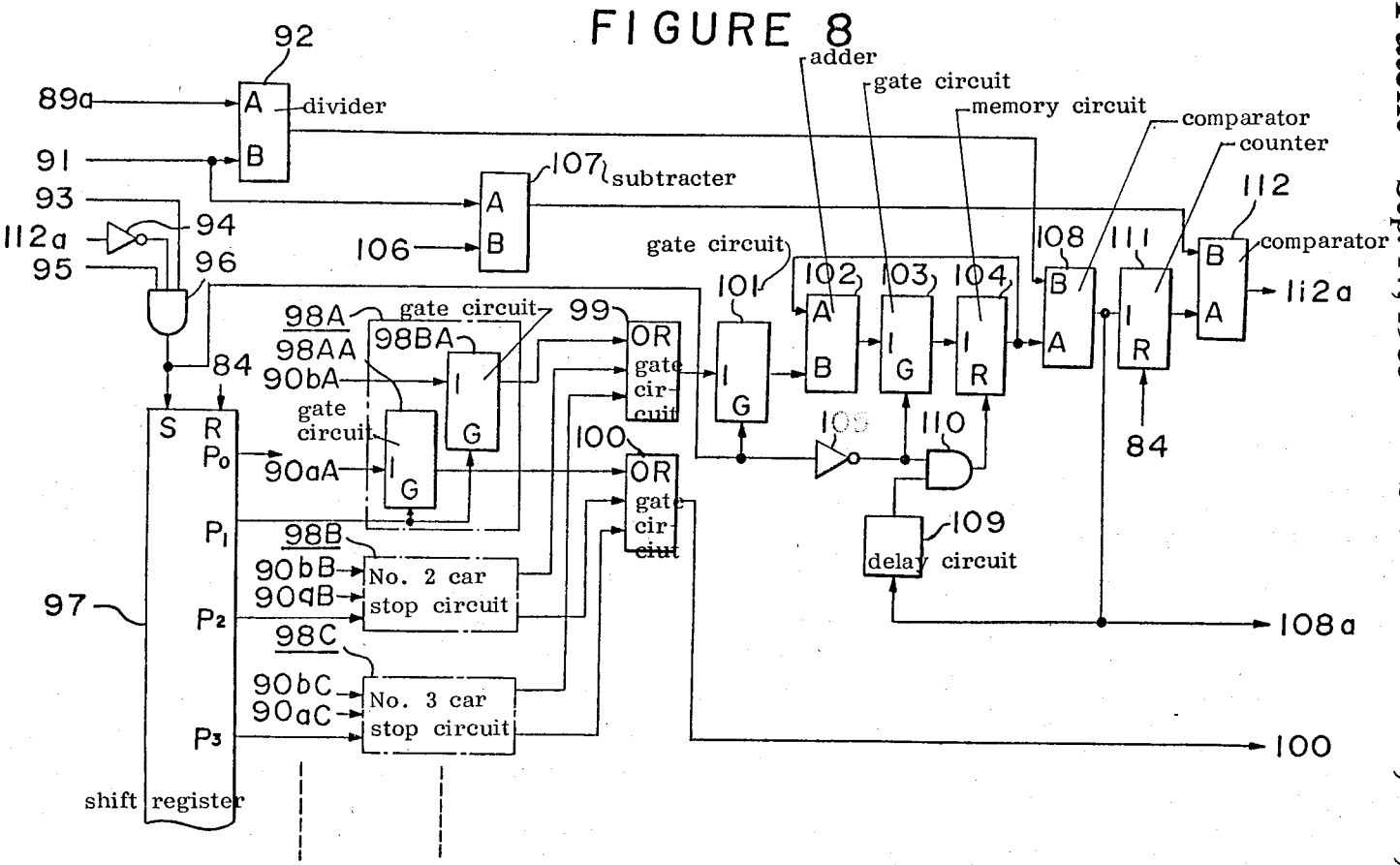

An embodiment of the present invention will be described with reference to FIGS. 1 to 6. In the Figures, the suffixed "−1" to "−3" of the references respectively designate cars No. 1 to No. 3 and the suffixes "A", "B", "C" . . . of the references respectively designate the first, the second, the third time zones. In FIGS. 5 and 6, the reference numeral (51) designates an increased load signal expressed by a percentage of the car load which increases dependent on the entrance of passengers to the loading capacity of the car; (52) designates a door closing pulse signal (an adding timing pulse) which changes to "H" by the closing of the door after the car stops in response to a hall call and the door opening; (53) designates an increased load operating circuit; (53A) designates an adder for adding an input A to an input B; (53B) designates a gate circuit for outputting an input I when an input G changes to "H"; (53C) designates a memory circuit which memorizes the data of the input I to output a signal and makes the data zero for resetting when an input R changes to "H"; (54) designates an adder for adding the input A to the input B to output a signal; (55) designates an increased load reference signal which corresponds, for example, to a value of 500%; (56) designates a comparator which compares the input A with the input B to change an output to "H" when $B \geqq A$ is given and otherwise to keep the output in "L" level; (57) designates an OR gate; (58) designates a monostable device for generating a pulse having a predetermined time width when the input changes to "H"; (59) designates a time signal generated from a clock (not shown); (60) designates a signal which corresponds to 0:00 a.m.; (61) designates a coincidence detection circuit which changes the output to "H" when the input A is conicident with the input B; (62) designates a monostable device similar to the monostable device (58); (63) designates a shift register which changes only an output $P_0$ to "H" by resetting data when an input R changes to "H", and causes sequentially the outputs $P_1$, $P_2$, . . . to be in "H" level for each time when an input S changes to "H"; (63*a*), (63*b*), (63*c*) . . . respectively designate the first, the second, the third . . . time zone initiation signals; (64) designates a delay circuit which changes to "H" after a predetermined time when the input becomes "H" level (which is shorter than the pulse width of the time zone renewal pulse (10)); (65) designates an OR gate; (66) designates a monostable device which has a function similar to the monostable device (58) to generate the time zone renewal pulse (10); (67) designates a NOT gate; (68) designates a monostable device similar to the monostable device (58); (69) designates an AND gate; and (70) designates a R-S flip-flop (referred to as a memory hereinbelow) for rendering the first, the second, the third . . . time zone signals (12*a*), (12*b*), (12*c*) . . . "H" level when set.

The operation of the embodiment will be described.

When a car No. 1 stops in response to a hall call and passengers enter into the car, the car load increases whereby a increased load signal (51-1) corresponding to the increased car load is input to the adder (53A-1) to be added to a value memorized in the memory circuit (53C-1). When the door closing signal (52-1) changes to "H" by closing the door, the gate circuit (53B-1) is opened and data of the adder (53A-1) are memorized in the memory circuit (53-1). In each of the increased load operating circuits (53-1)–(53-3) of the respective cars, the increased load is added for each time of car stopping and the increased loads of the cars are added by the adder (54). When a value thus added exceeds 500%, the output of the comparator (56) changes to "H" and the monostable device (58) generates a pulse. The output of the OR gate (57) also changes to "H" and the memory circuits (53C-1)–(53C-3) for the cars are all reset. On the other hand, the time signal (59) coincides with the signal (60) at 0:00 a.m. whereby the output of the coincidence detection circuit (61) changes to "H" and the monostable device (62) generates a pulse, thus the shift register (63) is reset to change the first time zone initiation signal (63*a*) to "H". When the monostable device (58) generates the pulse, the first time zone initiation signal (63*a*)

changes to "L" whereas the second time zone initiation signal (63*b*) changes to "H", thus the output of the OR gate (65) is changed to "H" to change the time zone renewal pulse (10) as the output of the monostable device (66) to "H". When the time zone renewal pulse (10) changes to "L", the output of the NOT gate (67) changes to "H" to open the AND gate (69B). On the other hand, when the second time zone initiation signal (63*b*) changes to "H", the output of the delay circuit (64B) changes to "H" with a short time delay whereby the output of the AND gate (69B) changes to "H" to set the memory (70B) and the second time zone signal (12*b*) changes to "H". During that time, the memory (70A) has been set to keep the first time zone signal (12*a*) in "H" level. When the output of the NOT gate (67) changes to "H", the monostable device (68) generates a pulse to reset the memory (70A) and the first time zone signal (12*a*) changes to "L".

Figure 1:
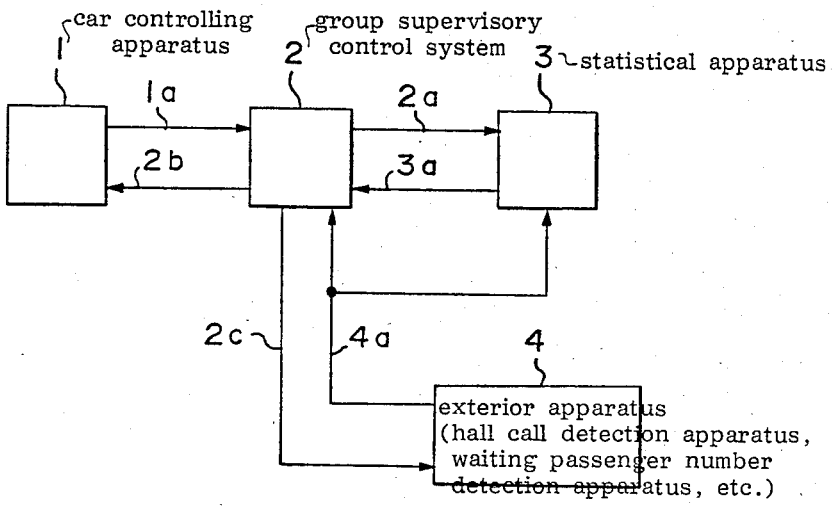
FIG. 1 is a block diagram of the conventional group supervisory control system for an elevator.
Figure 2:
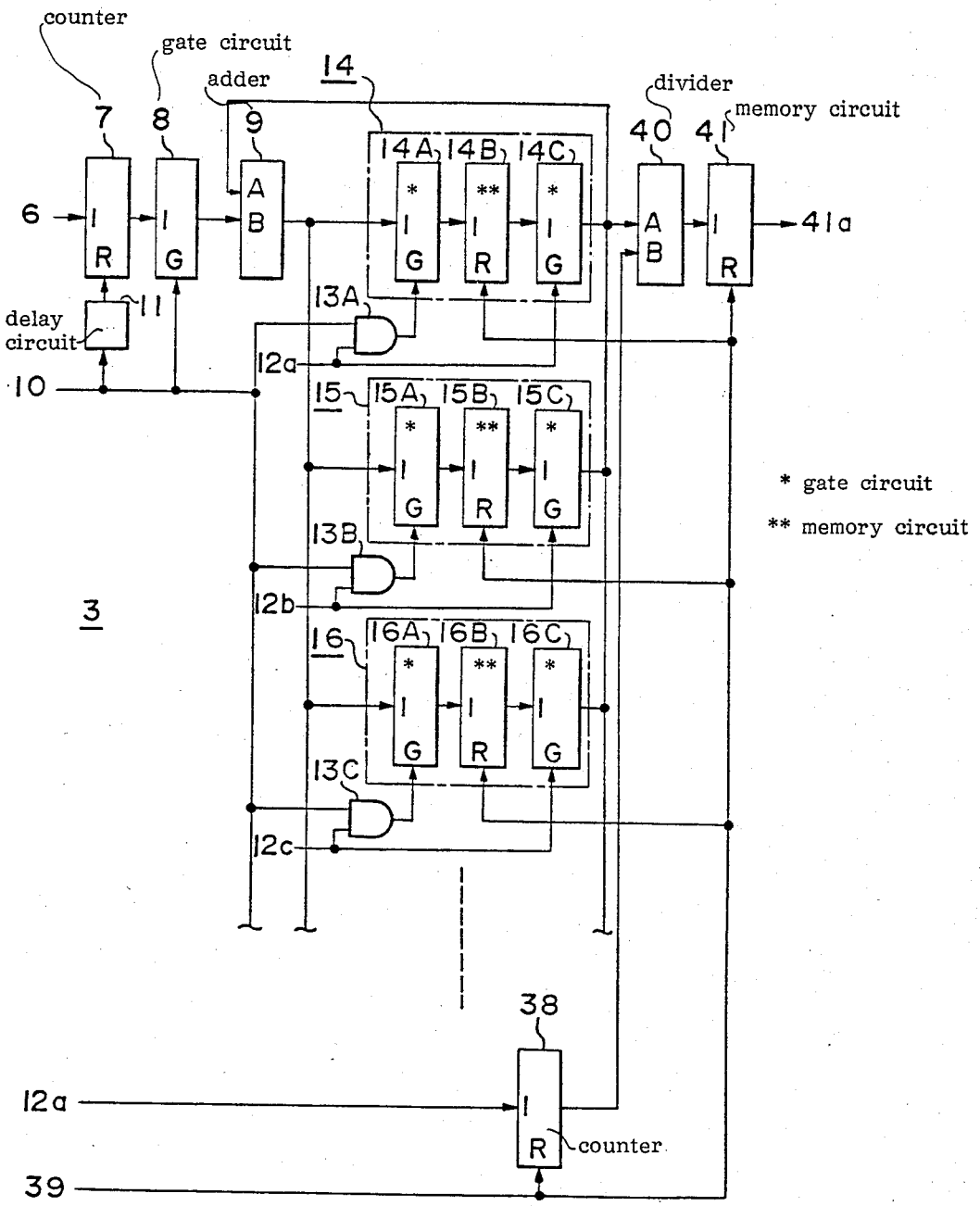
FIG. 2 is a block diagram showing a part of the statistics apparatus of FIG. 1.
Figure 3:
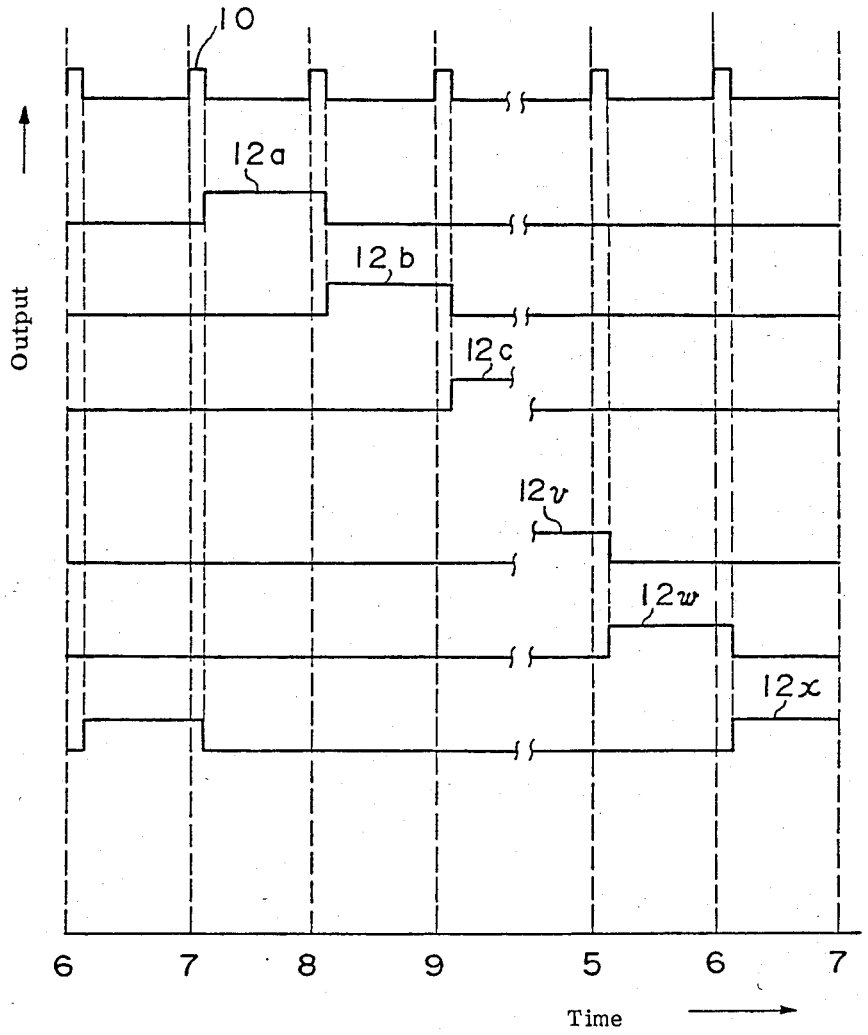
FIG. 3 is a time chart of the apparatus in FIG. 2.
Figure 4:
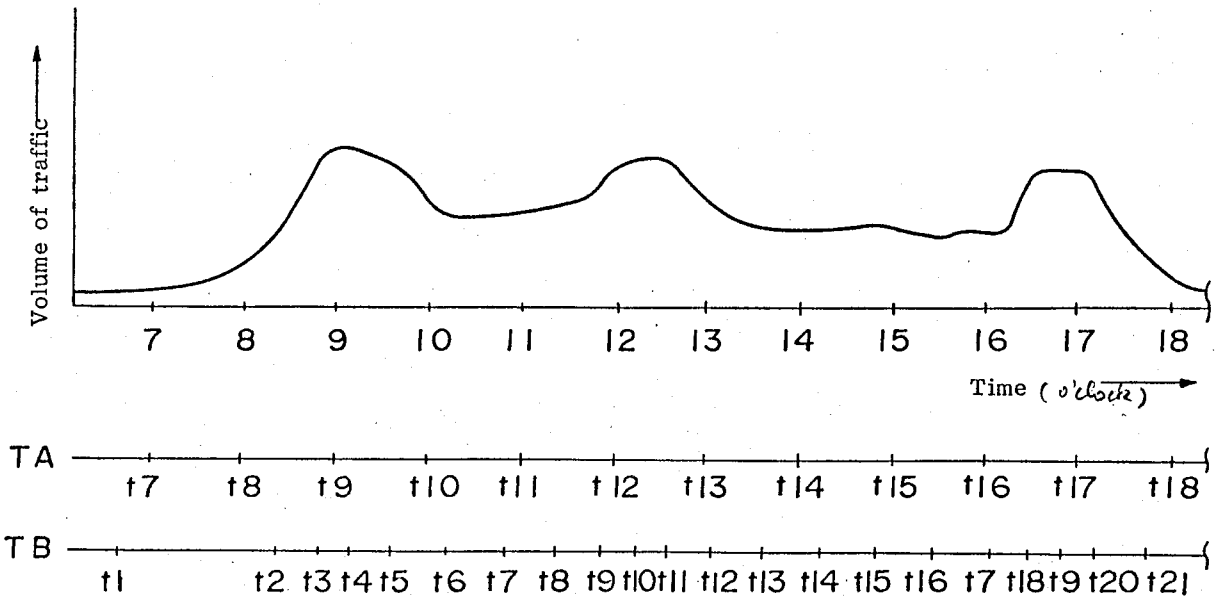
FIG. 4 is a diagram showing traffic conditions for an elevator.

Thus, the time zone renewal pulse (10) changes to "H" for each time when the added value of the increased loads of the cars exceeds the increased load reference value (55) to sequentially generate the time zone signals (12*a*), (12*b*), (12*c*) . . . whereby finely divided time zones can be given as shown in the time axis TB of FIG. 4. Thus, a correct statistical data of the hall call in changed time zones can be obtained as described with reference to FIG. 2.

FIGS. 7–10 illustrate another embodiment of the present invention.

In this embodiment, the increased load in the last day is divided by number of designated time zones to obtain average times of passenger entrance for each time zone of the last day thereby giving the same passenger entrance times for all the designated time zones.

In the figures, the reference numeral (80) designates gate circuits similar to the gate circuit (53B); (81) designates an OR gate; (82), (83) designate gate circuits similar to the gate circuit (53B); (84) designates a pulse which corresponds to the output of the monostable device (62) in FIG. 5 and is generated at 0:00 a.m.; (85) designates a shift register similar to the shift register (63); (86) designates a delay circuit similar to the delay circuit (64); (87) designates an adder similar to the adder (53A); (88) designates a gate circuit similar to the gate circuit (53B); (89) designates a memory circuit similar to the memory circuit (53C); (89*a*) designates an output signal indicative of the total times of passenger entrance; (90) designates car stop time indication-increased load output circuits; (90AA), (90BA) designate gate circuits similar to the gate circuit (53B); (90CA), (90DA) designate memory circuits similar to the memory circuits (53C); (90*a*A) designates the output of the memory circuit (90CA) as a time indication signal; (90*b*A) designates the output of the memory circuit (90DA) as a signal for indicating number of passenger entrance; (91) designates number of designated time zones in a day (such as 24 if the time zone of one hour is given); (92) designates a divider for outputting a value obtained by dividing the input A by the input B; (93) designates a scanning pulse having a sufficiently short period; (94) designates a NOT gate; (95) designates a read-out signal which changes to "H" at, for example, 11:59 p.m.; (96) designates an AND gate; (97) designates a shift register similar to the shift register (63); (98) designates a stop gate circuit; (98AA), (98BA) designate gate circuits similar to the gate circuit (53B); (99), (100) designate OR gate circuits; (100*a*) designates the output of the OR gate circuit (100) as a time indication signal generated when the number of passenger entrance equal the mean value; (101) designates a gate circuit similar to the gate circuit (53B); (102) designates an adder similar to the adder (53A); (103) designates a gate circuit similar to the gate circuit (53B); (104) designates a memory circuit similar to the memory circuit (53C); (105) designates a NOT gate; (106) designates a constant corresponding to 1; (107) designates a subtracter for subtracting the input B from the input A; (108) designates a comparator whose output changes to "H" when the input A≧the input B; (108*a*) designates the output of the comparator; (109) designates a delay circuit similar to the delay circuit (64); (110) designates an AND gate; (111) designates a counter which counts times the input I changing to "H" to output a signal and is reset to zero when the input R changes to "H"; (112) designates a comparator similar to the comparator (108) for generating the output (112*a*); (113) designates a delay circuit similar to the delay circuit (64); (114) designates a shift register similar to the shift register (63); (115) designates an AND gate; (116) designates a gate circuit similar to the gate circuit (53B); (117) designates a memory circuit for memorizing the input to output a signal; (117*a*) designates the output of the memory circuit as a time zone initiation time signal; and (118) designates a coincidence detector similar to the coincidence detector (61). Parts and devices other than those described above are the same as those in FIG. 6.

The operation of this embodiment will be described. The increased load of each car is output through the respective gate circuits (80-1)–(80-3) for each door closing to be added in the adder (54). The output of the OR gate (81) changes to "H" for each time the door closes to open the gate circuits (82), (83). Since the shift register (85) (as well as the other shift registers (47), (114)) is reset by the signal (84) at 0:00 a.m., the output $P_1$ changes to "H" whereby the output of the adder (54), i.e., the increased load is memorized in the memory circuit (90DA) through the gate circuits (83), (90BA) to produce the output (90*b*A). At the same time, the time signal (59) indicating the present time is memorized in the memory circuit (90CA) through the gate circuits (82), (90AA) to produce the output (90*a*A). The output of the gate circuit (83) is input to the adder (87) to be added with the increased load memorized in the memory circuit (89). When the output of the delay circuit (86) changes to "H" with a slight delay after the output of the OR gate (81) has changed to "H", the gate circuit (88) is opened and data of the adder (87) is memorized in the memory circuit (89) to generate the total increased load signal (89*a*).

When the output of the OR gate (81) changes to "H" after the car has stopped and the door closed, the output $P_1$ of the shift register (85) changes to "L" whereas the output $P_2$ changes to "H". Then, the outputs (90*a*C), (90*b*C) are generated from the third car stop time indication-increased load output circuit (90C) and the time indication and the increased load for each car stopping are output in the same manner as described above.

When the output (112*a*) of the comparator (112) is in "L" level, the output of the NOT gate (94) is in "H" level. When the read-out signal (95) changes to "H" at 11:59 p.m., the output of the AND gate (96) is a pulse dependent on the scanning pulse (93) whereby the outputs $P_1$, $P_2$, $P_3$, . . . of the shift register (97) sequentially change to "H" to scan the first, the second, the third, . . . stop gate circuits (98A), (98B), (98C), . . . . That is, when the output $P_1$ changes to "H", the gate circuits (90AA), (90BA) are opened to output the signals (90*a*A), (90*b*A). Similarly, the outputs are generated from the second, the third, . . . stop gate circuits (98B), (98C) . . . . Each increased load is passed through the OR gate circuit (99) and is input to the adder (102) for each time the gate circuit (101) is opened by the pulse from the AND gate (96) whereby the increased load is added to the increased load memorized in the memory circuit (104). When the pulse which opens the gate circuit (101) changes to "L", the output of the NOT gate (105) changes to "H" to open the gate circuit (103) and data of the adder (102) are memorized in the memory circuit (104) and are input to the comparator (108).

The divider (92) outputs an average times of passenger entrance per hour by dividing the total increased load (89*a*) by 24 designated time zones of a day to supply it to the comparator (108). When the output of the memory circuit (104) exceeds the average passenger entrance times, the output of the comparator (108) changes to "H". As a result, the output of the delay circuit (109) changes to "H" to change the output of the AND gate (110) to "H" whereby the memory circuit (104) is reset to be zero output thereby changing the output of the comparator (108) to "L". As a result, the output (108*a*) of the comparator (108) becomes pulses which are input to the shift register (114) whereby the outputs $P_1$, $P_2$, . . . are sequentially changed to "H". The output (100*a*) produced by passing the time indication signal (90*a*A) through the OR gate circuit (100) indicates the time at which the passages entrance times reach the mean value. When both the output $P_1$ of the shift register (114) and the output of the delay circuit (113) change to "H", the output of the AND gate (115B) changes to "H" to open the gate circuit (116B) and the time indication signal (100*a*) is memorized in the memory circuit (117B) to output the second time zone initiation time signal (117*a*B) (the first time zone initiation time signal (117*a*A) is a constant corresponding to 0:00 a.m.). Similarly, for each time when the pulse (108*a*) changes to "H", that time is memorized in the memory circuits (117C), . . . .

The counter (111) counts the number of pulse (108*a*) to output to the comparator (112). The subtracter (107) outputs the numeral 23 which is obtained by subtracting 1 from 24 of the designated time zones. When the number of the counted pulses reaches 23, the output (112*a*) changes to "H" to change the output of the NOT gate (94) to "L" whereby the scanning pulse of the shift register (97) is stopped.

When it is 0:00 a.m., the time signal (59) coincides with the first time zone initiation time signal (117*a*A) to change the output of the coincidence detection circuit (118A) to "H". Thus, the first time zone signal (12*a*) changes to "H" as described with reference to FIG. 6. Similarly, when the time signal (59) coincides with the second time zone initiation time signal (117*a*B), the second time zone signal (12*b*) changes to "H".

Thus, at 11:59 p.m., the time at which the passenger entrance times reach the average value of passenger entrance of the present day, the system is operated to determine the time as time zone initiation time and new time zones are determined for each of the initiation time for the next day. Thus, it is possible to determine the time zone for the same passenger entrance times.

Figure 11:
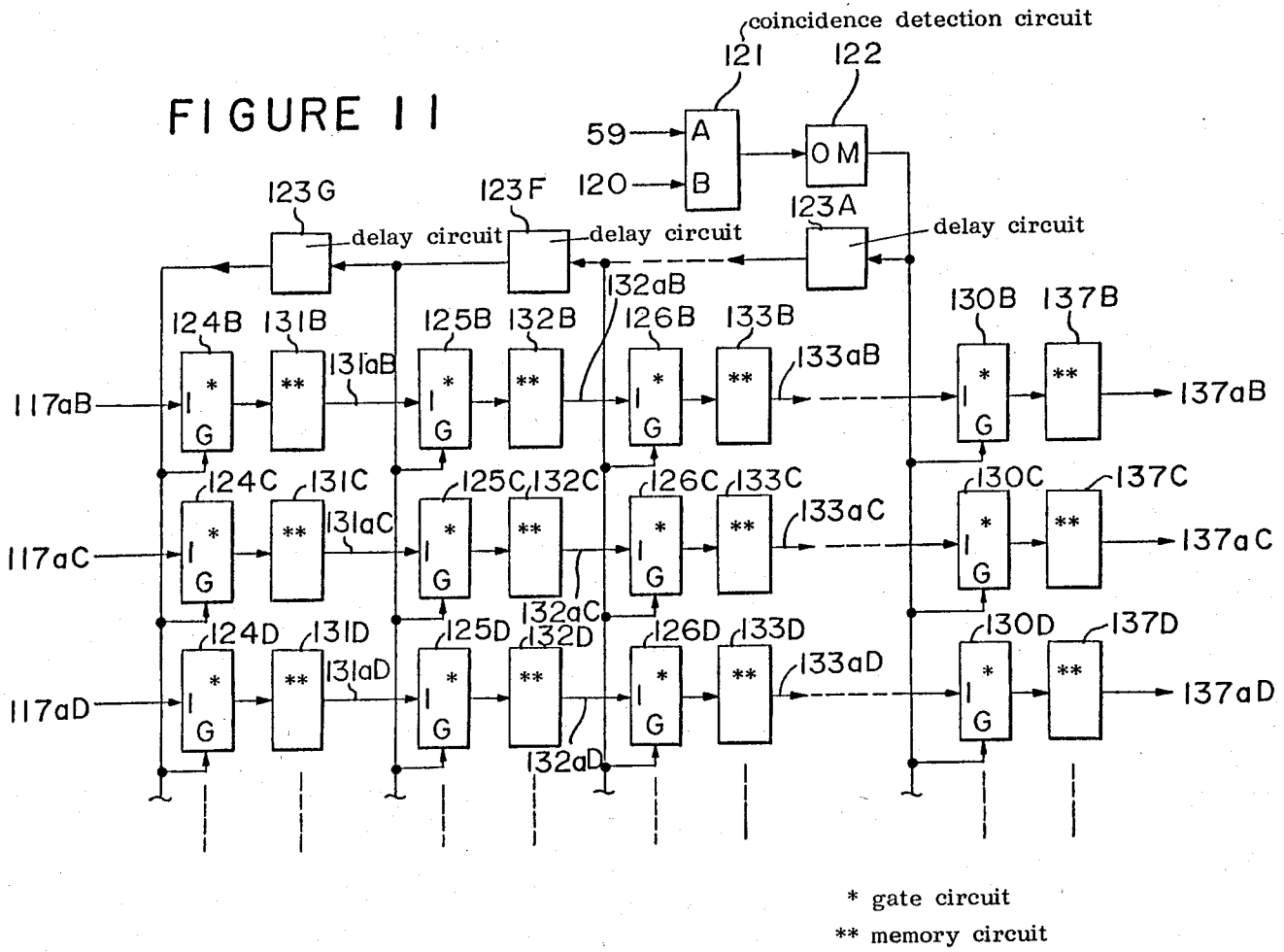
FIGS. 11 and 12 are block diagrams of still another embodiment of the present invention.
Figure 12:
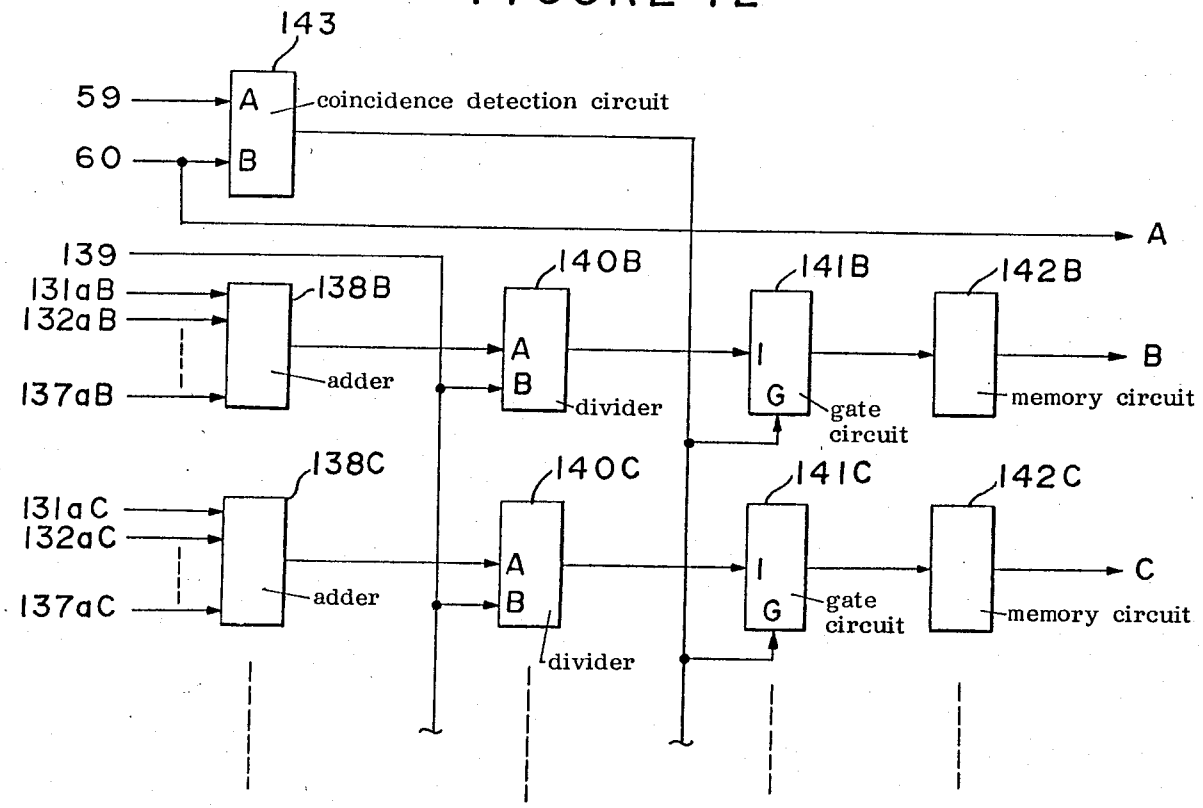

FIGS. 11 and 12 illustrate a separate embodiment of the present invention. The FIGS. 7 to 10 are utilized for this embodiment.

Figure 9:
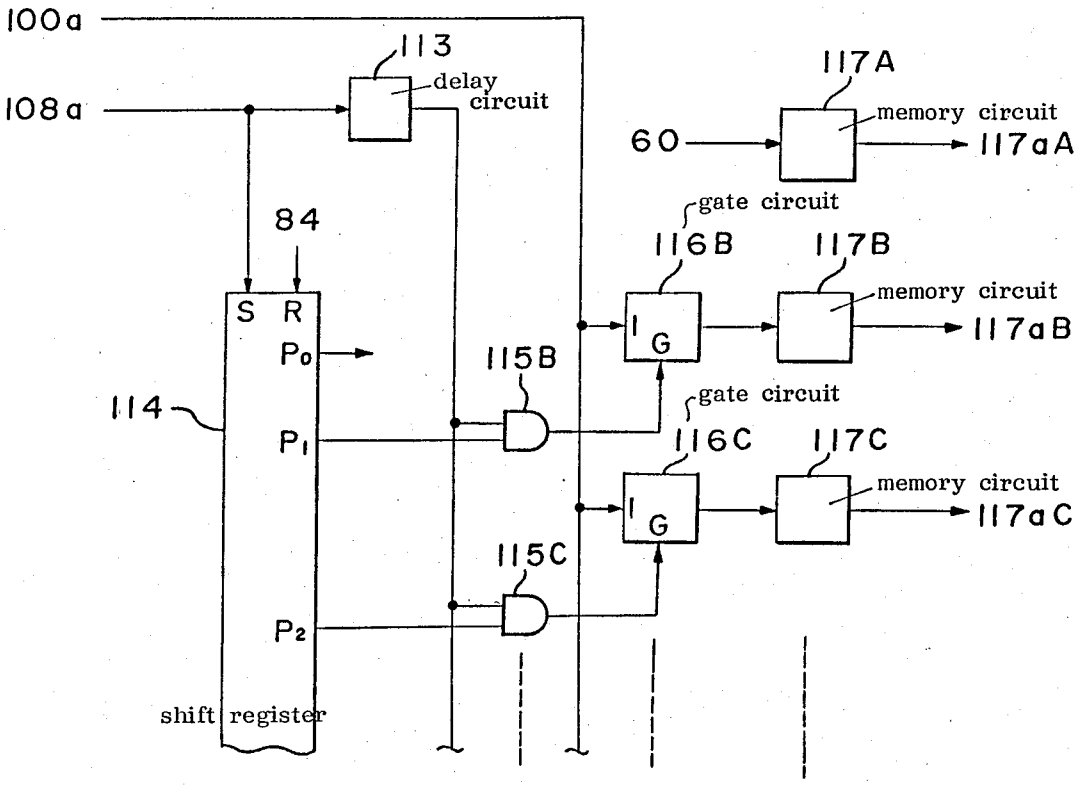
Figure 10:
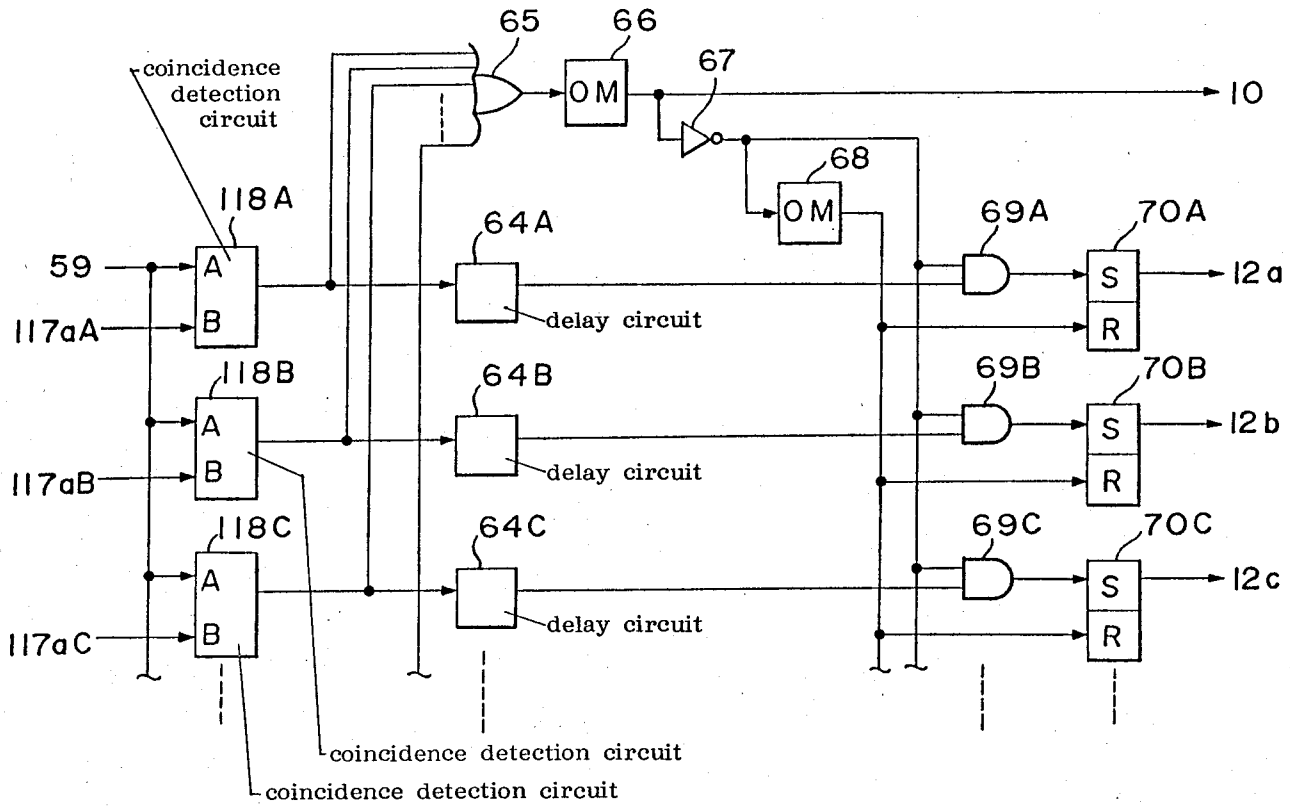

In this embodiment, the time zone initiation time signals (117*a*A), (117*a*B), (117*a*C), . . . described with reference to FIG. 9 are used without any modification, but the mean value of the previous time zone initiation time is determined to output it as new time zone initiation time signals (A), (B), (C), . . . .

In the figures, the reference numeral (120) designates a signal corresponding to 30 seconds past 11:59 p.m.; (122) designates a monostable device similar to the monostable device (62); (123) designates a delay circuit similar to the delay circuit (64); (124)–(130) designate gate circuits similar to the gate circuit (53); (131)–(137) designates memory circuits similar to the memory circuit (53C); (131*a*)–(137*a*) respectively designate the outputs of the memory circuits (131)–(137); (138) designates an adder for adding inputs; (139) designates a constant, (for example, the numeral 7); (140) designates a divider similar to the divider (92); (141) designates a gate circuit similar to the gate circuit (53B); (142) designates a memory circuit similar to the memory circuit (53C); (143) designates a coincidence detection circuit similar to the coincidence detection circuit (61) and the signal (60) and the outputs A, B, C, . . . of the memory circuits (142B), (142C), . . . are the same as the signals (117*a*A), (117*a*B), . . . in FIG. 10.

The operation of the embodiment will be described.

At the time when processing of the time zone initiation times of the present day has been completed at, for example, 30 seconds past 11:59 p.m., the output of the coincidence detection circuit (121) changes to "H" and the monostable device (122) outputs a pulse. The gate circuits (130B), (130C), . . . are opened by the pulse and the data (the time zone initiation time signal six days before) of the memory circuits (136B), (136C), . . . (not shown) at the previous stage are fed to the memory circuits (137B), (137C), . . . to be memorized as a time zone initiation time seven days before while the time zone initiation time signal which has been memorized as the previous seven day data are cancelled. Similarly, each of the gate circuits is opened through the respective delay circuits (123A)–(123G) to sequentially shift the data of the memory circuits one by one in the right direction and finally, the time zone initiation time signals (117*a*B), (117*a*C), . . . of the present day are memorized in the memory circuits (131B), (131C), . . . . Thus, the time zone initiation time signals for a week are memorized in each memory circuit. The outputs (131*a*B)–(137*a*B), (131*a*C)–(137*a*C) thus memorized in each of the memory circuit are added by the respective adders (138B), (138C), . . . and the sums in the adders are respectively divided by the respective dividers (140B), (140C), . . . to obtain the mean value for the seven days. At 30 seconds past 11:59 p.m., the output of the coincidence detection circuit (143) changes to "H" to open the gate circuits (141B), (141C), . . . and the aforementioned mean value is memorized in the memory circuits (142B), (142C), . . . . The mean values are generated as outputs B, C, . . . which are used as the second, the third, . . . time zone initiation time signal (117*a*B), (117*a*C), . . . . The output A is a signal (60) indicative of 0:00 a.m. which is the first time zone initiation time signal (117*a*A) of FIG. 10.

Figure 13:
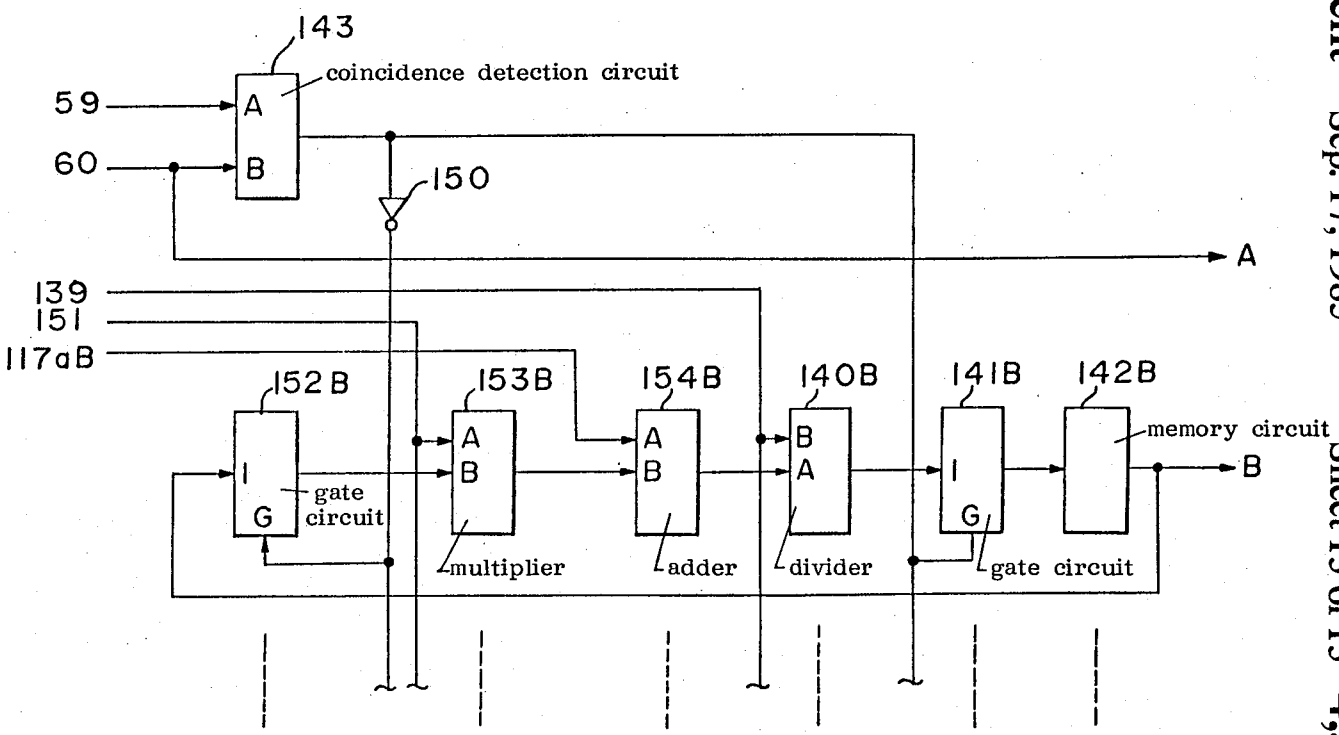
FIG. 13 is a block diagram of a separate embodiment of the present invention corresponding to the FIGS. 11 and 12.

FIG. 13 illustrates still another embodiment of the present invention instead of the embodiment shown in FIGS. 11 and 12. However, FIGS. 7–10 are commonly used for this embodiment.

In the embodiment, the time zone initiation time is not merely used as the previous average value but is used as a value weighted dependent on approaching to the present time from the past time.

In FIG. 13, the reference numeral (150) designates a NOT gate; (151) designates a value obtained by subtracting 1 from the constant value (139) (7−1=6 in the embodiment); (152) designates a gate circuit similar to the gate circuit (53B); (153) designates a multiplier for multiplying the input A by the input B; and (154) designates an adder similar to the adder (87). The description has been made with reference to the second time zone initiation time signal (117*a*B). The same description can be applied to the third time zone initiation time signal (117*a*C) and so on.

When it is other than 0:00 a.m., the output of the coincidence detection circuit (143) is in "L" level and the output of the NOT gate (150) is in "H" level whereby the gate circuit (152B) is opened. The time zone initiation time (mean value) which has been memorized in the memory circuit (142B) for the previous days is input through the gate circuit (152B) to the multiplier (153B) in which multiplying of 6 is performed. The time zone initiation time signal (117*a*B) of FIG. 9 is added in the adder (154B) and a new mean value is obtained by the divider (140B). At 0:00 p.m., the output of the coincidence detection circuit (143) changes to "H" to open the gate circuit (141B) and the data of the divider (140B) is memorized in the memory circuit (142B). Thus, the memory circuit (142B) memorizes the mean value of the time zone initiation times which have been input.

The process described above can be expressed as follows: Time zone initiation time=[time zone initiation time for the previous days x (N−1)+G]/N wherein G is the second, the third, . . . time zone initiation time signals (117*a*B), (117*a*C), . . . and N is a constant.

In the embodiment, a statistical treatment is carried out based on increased load to determine a time zone. It is possible to carry out a statistical treatment based on data such as registration of hall call, hall waiting time etc. In the embodiment, the statistical treatment for each time zone is shown as an example and it is not limited to the embodiments.

It is also possible that each time zone has an inherent time zone for each data, for each floor or for each direction.

As described above, in the present invention, the traffic data and the service data for an elevator are gathered for each time zone in the previous time interval to control the driving of the cars based on the statistical data thus obtained wherein the time zones are determined when a predetermined condition concerning the traffic and service data is established. A correct statistical data can, therefore, be obtained without increasing capacity of memory to improve services of group supervisory control system.

I claim:

1. A group supervisory control system for an elevator in which a day is divided by a plurality of time zones, and in which traffic and service data for an elevator are statistically gathered for each time zone in the past time and the driving of cars are controlled based on the statistical data, said control system comprising:

traffic data recording circuit for recording the traffic data of the elevator for a plurality of time zones;

reference setting means for determining a reference value;

time zone setting device responsive to said traffic data recorded by said traffic data recording circuit and said reference value wherein said time zone setting device includes a comparator for comparing said recorded traffic data and said reference value and wherein said time zone setting device outputs a signal for setting a new plurality of time zones.

2. The group supervisory control system according to claim 1, wherein said time zone setting device sets said new plurality of time zones in such a manner that the period of each of second time zones is inversely proportional to the traffic demand for said elevator system.

3. A group supervisory control system according to claim 1, wherein said time zone setting device sets said new plurality of time zones such that the period between said second plurality of time zones is dependent upon the mean value of recorded data in a plurality of time zones of the days in the past time.

4. A group supervisory control system according to claim 3, wherein said time zone setting device sets said new plurality of time zones in such a manner that the period of each of said plurality of time zones is determined by means of weighting more heavily the data of the time zones in the past time according to the nearness of the days to a present day.

* * * * *